US009010758B1

(12) United States Patent
Malmloff

(10) Patent No.: US 9,010,758 B1
(45) Date of Patent: Apr. 21, 2015

(54) PLAYING CARD HOLDER

(71) Applicant: Craig Malmloff, Fishers, IN (US)

(72) Inventor: Craig Malmloff, Fishers, IN (US)

( * ) Notice: Subject to any disclaimer, the term of this patent is extended or adjusted under 35 U.S.C. 154(b) by 0 days.

(21) Appl. No.: 14/079,702

(22) Filed: Nov. 14, 2013

Related U.S. Application Data

(60) Provisional application No. 61/734,103, filed on Dec. 6, 2012.

(51) Int. Cl.
*A63F 1/10* (2006.01)

(52) U.S. Cl.
CPC ..... *A63F 1/10* (2013.01)

(58) Field of Classification Search
CPC ..... A63F 1/10
USPC ..... 273/150, 148 A
See application file for complete search history.

(56) References Cited

U.S. PATENT DOCUMENTS

| | | | | | |
|---|---|---|---|---|---|
| 1,416,447 | A * | 5/1922 | Castles | ..... | 273/150 |
| 2,231,637 | A * | 2/1941 | Ramos | ..... | 273/150 |
| 2,729,452 | A * | 1/1956 | Baumann | ..... | 273/150 |
| 4,927,149 | A * | 5/1990 | Bull | ..... | 273/150 |
| 5,029,797 | A * | 7/1991 | Levorchick et al. | ..... | 248/459 |
| 8,240,668 | B1 * | 8/2012 | Kimbrell | ..... | 273/150 |

* cited by examiner

*Primary Examiner* — Benjamin Layno
(74) *Attorney, Agent, or Firm* — Boyle Fredrickson, S.C.

(57) ABSTRACT

A playing card holder includes a first and second opposing panel defining a playing card retaining space therein, and a foldable kickstand for selectively supporting the playing card holder in an upright orientation. The playing card holder includes a plurality of protrusions or other card retention structures extending into the retaining space to engage the playing cards therein.

19 Claims, 6 Drawing Sheets

PLAYING CARD HOLDER

CROSS REFERENCE TO A RELATED APPLICATION

This application claims the benefit of U.S. Provisional Application Ser. No. 61/734,103; filed Dec. 6, 2012, and entitled "PLAYING CARD HOLDER, the contents of which are hereby incorporated by reference in their entirety.

BACKGROUND OF THE INVENTION

1. Field of the Invention

The invention relates generally to a playing card holder, and more particularly, relates to a playing card holder device that can either be held in a hand or supported in an upright orientation on a table surface when a folding kickstand is deployed. The invention additionally relates to methods of fabricating and using such a device.

2. Discussion of the Related Art

Many recreational games include the use of playing cards, either alone or in combination with other game elements such as dice, boards, playing pieces, currency, chips, etc. As such, it is often necessary or at least desirable to perform additional activities such as moving game pieces, rolling dice, etc. while simultaneously holding onto one's playing cards. Players ideally want to hold cards with one hand while performing activities with the other to avoid "showing their hands." In some games, it is necessary for a player to free both hands when performing some other task, in which case it is necessary for the player to lay his or her cards face down on the table while performing the other tasks. In addition, in games involving multiple playing cards, it is often desirable to display the playing cards in such a manner that each of the playing cards' markings, e.g., suite and/or numerical value, are visible only to their specific player.

Prior attempts have been made to provide a playing card holder that will free at least one of a player's hands from holding his or her playing cards while also displaying the playing cards' markings and/or that will facilitate the display of multiple cards. Some such prior playing card holders have included large blocks intended to be placed on a table top and include a slot for partially receiving playing card. Another prior playing card holder, described in U.S. Pat. No. 5,743,527, had a rigid plastic body including both a card retaining portion and a vertical support structure or pedestal extending away from the card retaining portion, thus allowing the card holder to stand independently when placed on a table top. However, the rigid structure of this and other known devices makes them inherently bulky and inconvenient for compact transportation. They are also relatively expensive to manufacture.

Thus, despite prior attempts to provide a playing card holding that is both easily held in one's hand as well as capable of being supported in an upright orientation on a table surface, while securely displaying the playing cards therein, there remains need for improvement

SUMMARY OF THE INVENTION

In accordance with a first aspect of the invention, a playing card holder is provided that includes a first and second panel formed from a blank of material folded along a length to define the first and second panels on opposing sides of the length. The playing card holder is retained in a folded configuration with the inner surfaces of the panels facing one another to define a pocket or retaining space therebetween for receiving playing cards.

All or a portion of the inner surface of one or both of the panels may be formed of a high friction material or otherwise configured to retain the playing cards in the retaining space. In one embodiment, a plurality of protrusions extends inwardly from the outwardly facing outer surfaces of the two panels and into the retaining space. The protrusions are configured to engage and retain the playing cards within the retaining space.

In accordance with yet another aspect of the invention, the playing card holder may include an integrated or separable support for supporting the playing card holder on a table or similar surface. The support may be formed from a foldable kickstand formed from the blank. The kickstand may be formed from a support tab and a locking tab located within the second panel that allows the card holder to rest upright on a table surface when deployed. Alternatively, when the folding kickstand is collapsed, the bottom edge of the kickstand tab and the bottom edge of holder lie in a common horizontal plane along at least substantially their entire surface areas, permitting the playing card holder to be easily held in a player's hand without interference from the kickstand.

In accordance with yet another aspect of the invention, the playing card holder may be transported in a first configuration, with the kickstand collapsed, and then erected into a playing configuration with the kickstand deployed. In one embodiment, the playing card holder may have a size substantially equal to that of a standard playing card when transported in the first configuration, permitting the playing card holder to be packaged with a deck of standard playing cards.

The playing card holder may be manufactured from a lightweight and inexpensive yet rigid and durable material. It is preferably manufactured by punching the blank from a larger sheet of material and punching attendant structures of the holder, such as the holding protrusions and/or the kickstand, from a larger sheet of material. It is conceivable that as few as one or as many as a large number of such kickstands could be formed from such a sheet using a suitable die.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention is illustrated in the accompanying drawings in which like reference numerals represent like parts throughout, and in which.

DETAILED DESCRIPTION OF THE PREFERRED EMBODIMENT

A wide variety of playing card holders could be constructed in accordance with the invention as defined by the claims. Hence, while several exemplary embodiments of the invention will now be described, it should be understood that the invention is in no way limited to any of those embodiments.

1. Playing Card Holder

Figure 1:
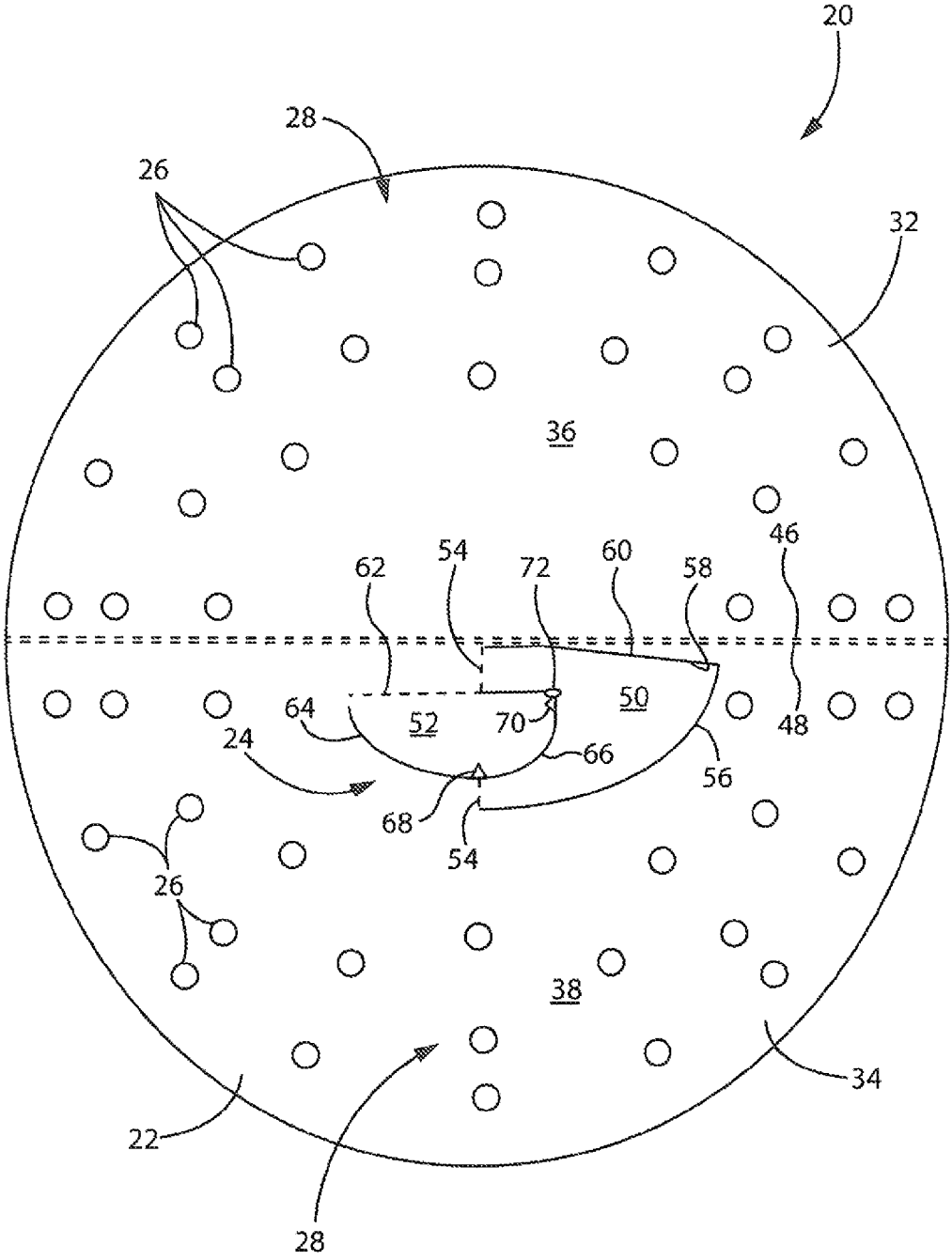
FIG. 1 is a top plan view of the playing card holder in accordance with an embodiment of the invention, showing the playing card holder unfolded.

FIGS. 1-6 illustrate a playing card holder 20 in accordance with one embodiment of the invention. Referring initially to FIG. 1, the playing card holder 20 is generally formed from a single blank 22 of material. The material may be any number of materials that are dimensionally stable and durable yet that can be punched or otherwise formed from a larger sheet of the material to form the blank 22. For example, the blank 22 may be formed from paper, fiber board, cardboard, corrugated board, polypropylene, polyvinyl-chloride, polyethylene terephthalate, or polystyrene or composites of one or more of these or similar materials. The playing card holder 20 preferably is manufactured by punching or otherwise cutting the blank 22 from a larger sheet of material, and subsequently bending or folding the blank 22 into the desirable folded configuration of the playing card holder 20. The remaining structures of the playing card holder 20, such as the kickstand 24 and/or playing card retention structures, for example holding protrusions 26 may similarly be punched, cut or otherwise formed congruently with the blank 22, from the same larger sheet of material. One or more such playing card holders 20, each with its integrated kickstand 24, could be formed from such a sheet using a suitable die. Alternatively, the playing card holder 20 and kickstand 24 may be formed from the sheet using multiple dies. The plurality of holding protrusions 26 or other card retention structures extending from the blank 22 may define a gripping surface 28 for retaining playing cards when the playing card holder 20 is in the desirable folded configuration. The gripping surface 28 may be formed on a surface of the sheet of material, or overlaid there on prior to folding the blank 22 into its folded configuration. The holding protrusions 26 preferably are formed by partially punching or embossing the sheet of material such that the protrusions are raised above the plane of the blank 22. Alternately, the gripping surface 28 may include an abrasive surface, high friction coating, mild adhesive coating, or combinations thereof capable of securely retaining playing cards.

The size of the blank 22 may be varied according to the size and number of playing cards indented to be retained within the playing card holder 20. However, when the playing card holder 20 is configured to retain standard "poker size" playing cards of 64 mm×89 mm, the blank 22 may have a width of preferably typically between 75 mm and 150 mm and more preferably between 100 mm and 145 mm, and a height of 75 mm to 200 mm and more preferably of between 100 mm to 150 mm. The blank 22 may have a thickness of between 0.5 mm and 10 mm and more preferably between 1 nm and 5 mm.

Figure 4:
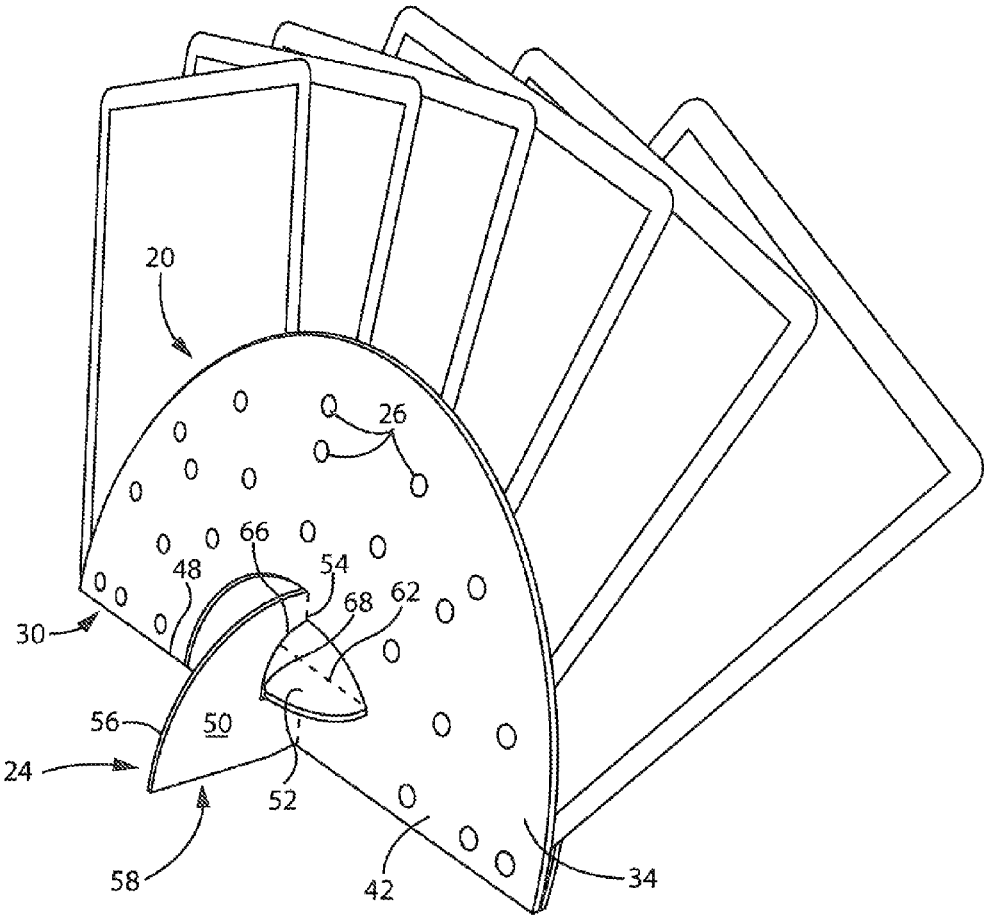
FIG. 4 is a perspective view the playing card holder of FIG. 1, showing the playing card holder supported by a deployed kickstand on a table surface while retaining a plurality of playing cards therein.

The blank 22 of this embodiment is circular but could be ovoid or of any of a number of other geometric shapes. It is foldable generally along a length or line 30 (not shown in FIG. 1) of the blank 22 to define a first panel 32 and a second panel 34 located on opposing sides of the line 30. Each of the first and second panels 32 and 34 has a lower base and an upper edge. The line 30 may bisect the blank as seen in FIG. 1, in which case the first and second panels 32, 34 may be of the same or highly similar size and shape. However, as best seen in FIG. 4, the fold line 30 of the blank 22 may be provided at a location that is significantly offset from the center of the blank 22 so that one of the first and second panels 32, 34 is noticeably higher than the other of the first and second panels 32, 34 by about 5 mm to 50 mm and more preferably 10 mm to 25 mm. This offset facilitates card reading as well as grasping smaller cards that may not extend significantly above the top of the panel 34. The first and second panels 32, 34 each have an inner surface 36, 38 and an outer surface 40, 42, such that the inner surface 36 of the first panel 32 faces the inner surface 38 of the second panel 34 when the blank 22 is folded along the line 30, to form a pocket or retaining space 44 between the first and second panels 32, 34. The outer surfaces 40, 42 of the first and second panels 32, 34 form holding surfaces that can be grasped by a user. The inner and outer surfaces 36, 38, 40, 42 could be unadorned or painted or printed in any desired manner.

Figure 5:
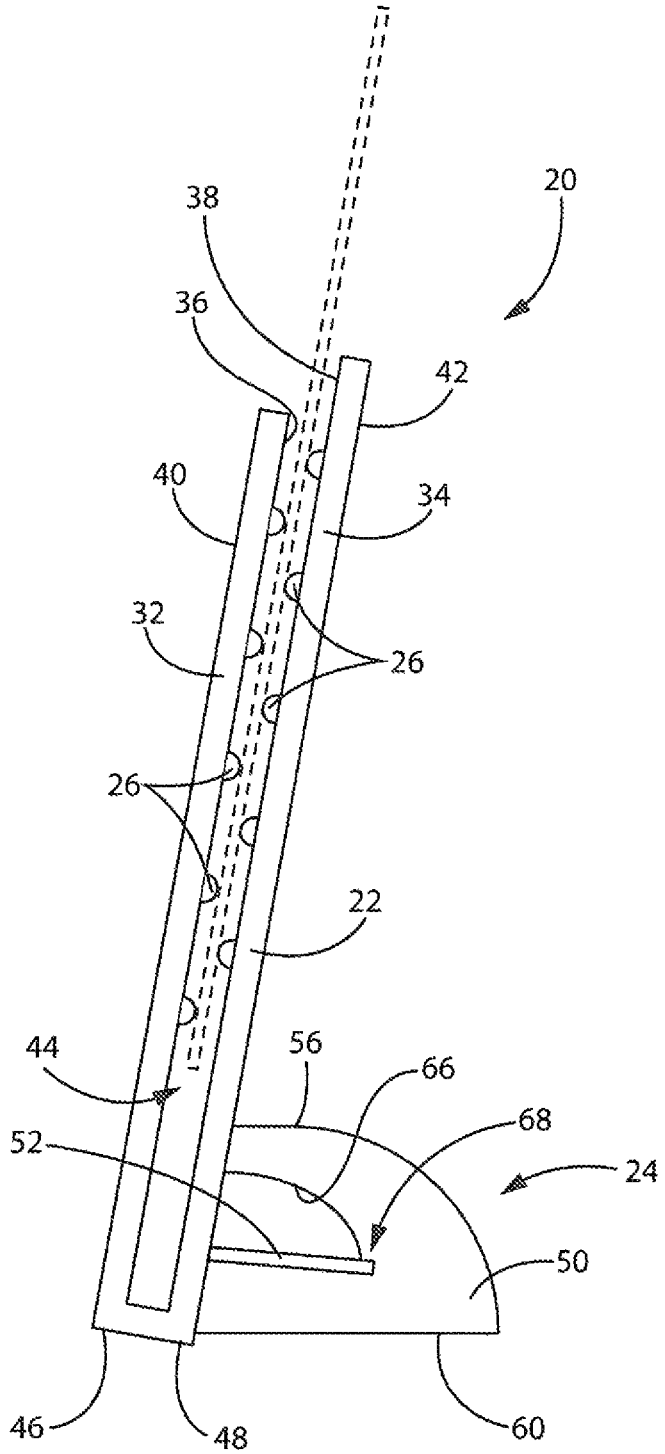
FIG. 5 is a side elevation view of the playing card holder of FIG. 1, showing the playing card holder supported by an extended or deployed kickstand on a table surface.

The inner surfaces 36, 38 of the first and second panels 32, 34 preferably are formed with gripping surfaces 28 that hold the playing cards in place within the pocket or retaining space 44. These gripping surfaces 28 may, for example, comprise a textured material formed on or overlaid onto the inner surface 36, 38 of at least one of the first and second panels 32, 34. In the illustrated embodiment, the gripping surfaces 28 are formed by a plurality of protrusions 26 extending above the plane of the inner surfaces 36, 38 of at least one, and preferably both, the first and second panels 32, 34 respectively. That is to say, the plurality of protrusions 26 extends inwardly from the inner surfaces 36, 38 of the panels 32, 34, when the blank 22 is folded along the line 30. The plurality of protrusions 26 may be formed by embossing, partially-punching the blank 22, or any similar method suitable for use in constructing a raised protrusion 26 on a surface. The panels 32, 34 may be single ply or multi-ply, with the plurality of protrusions 26 formed on an inner ply of material that is adhered to a flat outer ply of material, thus leaving a smooth appearance to the outer surfaces 40, 42 of the first and second panels 32, 34. In the illustrated embodiment, the protrusions 26 are formed by punching the blank partially or completely through from the outer surface 40, 42, leaving a dimpled outer surface. The size, number, and spacing of the protrusions 26 could vary dramatically with many factors including the material from which the blank 22 is formed, the size of the blank 22, and the desired retention forces to be imposed by the protrusions 26. In the illustrated embodiment, the protrusions 26 are dispersed across the inner surface 36, 38 of the first and second panels 32, 34 and approximately arraigned in multiple concentric circles, radiating outward from the center of the blank 22. However, any other arrangement of protrusions may be considered herein. The presence of multiple protrusions 26 at various distances between the line 30 and the outer edge of the blank 22 provides for multiple contact points with one or more playing cards, thereby enhancing the playing card holder's retention of playing cards. Furthermore, when the playing card holder 20 is in its folded configuration, as best seen in FIG. 5, the protrusions 26 on the first panel 32 are interposed from the protrusions 26 of the second panel 34, such that the protrusions 26 apply opposing force along the length of the playing card within the retaining space 44.

When folded at the line 30, the blank 22 may be folded along a single fold line coextensive with or near the line 30, or as see in FIG. 1, the blank 22 may be folded along a first fold line 46 and second fold line 48, producing a slightly wider pocket. The first and second fold lines 46, 48 are substantially parallel fold lines extending in parallel with but on opposite sides of the line 30 of the blank 22. The first and second fold lines 46, 48 may be spaced from one another by a generally horizontal floor having a width defining the thickness of the retaining space 44 at the bases of the panels. This thickness may be between 0.25 mm and 5 mm and more preferably between 0.5 mm and 1 mm. This spacing defines the maximum thickness of the retaining space or pocket 44 formed between the first and second panels 32, 34, which retaining space 44 is bisected by the line 30. Alternatively, rather than folding a single blank 22, independent first and second blank panels 32, 34 may be affixed to one another along the line 30, thereby forming a substantially folded configuration.

Figure 6:
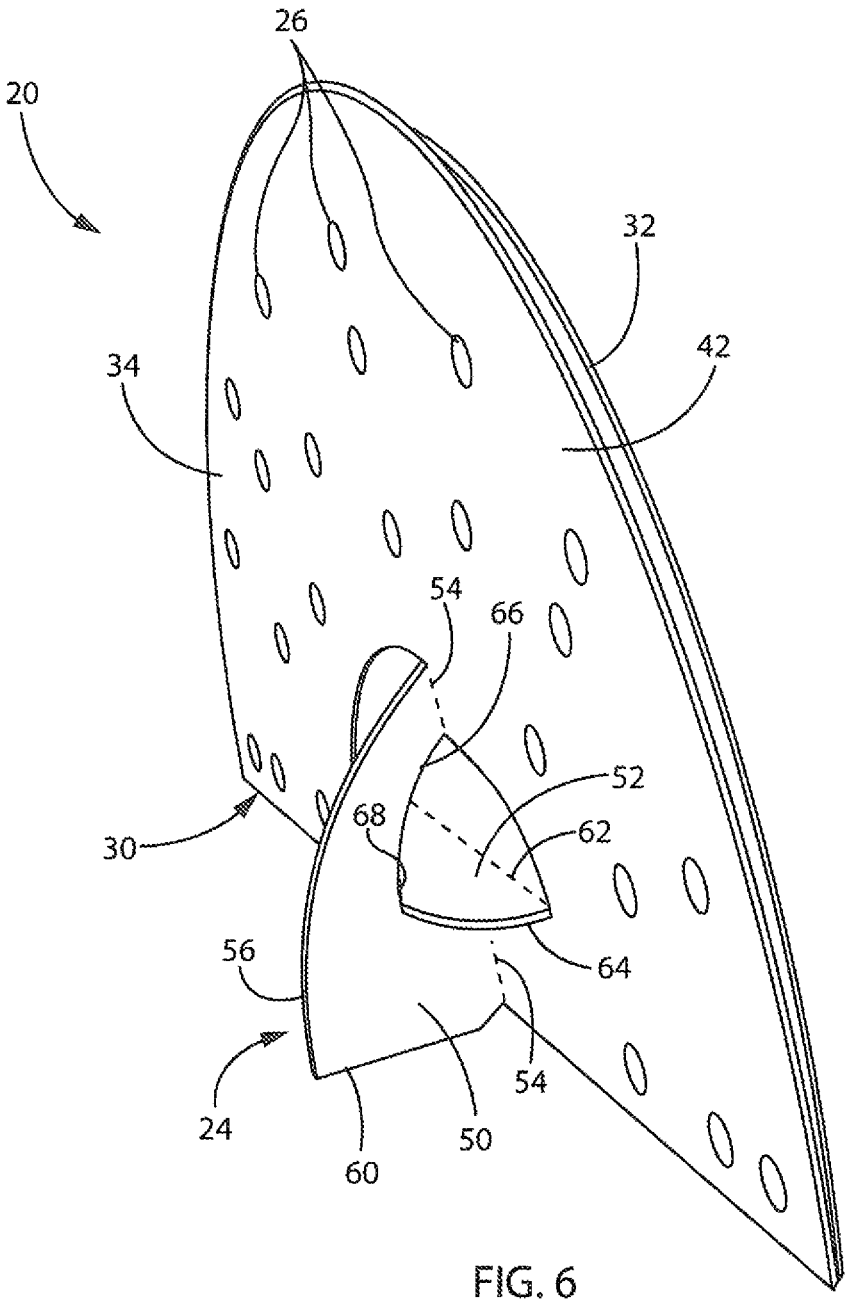
FIG. 6 is a side elevation view of the playing card holder of FIG. 1, showing the playing card holder supported by an extended or deployed kickstand on a table surface while retaining a plurality of playing cards therein.

Still referring to FIG. 1, the blank 22 further includes a foldable kickstand 24 formed within the second panel 34. The foldable kickstand 24 includes a support tab 50 and a locking tab 52. These tabs 50, 52 may extend fully through the width of the second panel 34, or as seen in FIG. 4-6, may extend partially through the width of the second panel 34, e.g., an outer ply of a multi-ply second panel. The support tab 50 is defined by a support tab fold line 54 substantially perpendicular to the first and second fold lines 46, 48. This support tab fold line 54 functions as a hinge for the support tab 50, and allows the support tab 50 to pivot to an extended position at an angle, and preferably substantially perpendicular to the second panel 34 as the kickstand 24 is deployed. The opposing ends of the support tab fold line 54 intersect with the support tab cut line 56, which defined the outer edge of the deployed support tab 50. A linear portion 58 of the support tab cut line defines a bottom edge 60 of the support tab 50, which lies generally in a common plane with the bottom surface of the playing card holder 20, to support the playing card holder 20 in an upright orientation. The bottom edge 60 of the support tab 50 may be disposed at an acute angle relative to the first and second fold lines 46, 48, such that first and second panels and the playing cards held therein are inclined at an acute angle relative to a vertical plane when, the bottom edge 60 of the first support tab rests on a horizontal support surface. This angle may be preferably typically between 1 degree and 45 degrees, and more preferably between 2 degrees and 10 degrees for ease of viewing cards.

The foldable kickstand 24 also includes a locking tab 52 configured to selectively engage the support tab 50 and the second panel 34 in order to lock the support tab 50 in its deployed position. The locking tab 52 is defined by a locking tab fold line 62 substantially parallel to the first and second fold lines 46, 48. This locking tab fold line 62 functions as a hinge for the locking tab 52, and allows the locking tab 52 to pivot to an extended position at an angle, preferably substantially perpendicular to both the planes of the second panel 34 and support tab 50, when the support tab 50 and locking tab 52 are extended. The opposing ends of the locking tab fold line 62 intersect with the locking tab cut line 64, and define the locking tab 52 therein.

As seen in FIG. 1, a portion of the locking tab cut line 64 interrupts the support tab fold line 54, and partially defines an inner edge 66 of the support tab 50. The locking tab cut line 64 further includes a first and second notch 68, 70 disposed therein. The first notch 68 is disposed within the locking tab cut fine 64, and is located at a point that intersects the support notch fold line 54. The first notch 68 is configured to engage the inner edge 66 of the support tab 50, via frictional engagement when both the support tab 50 and locking tab 52 have been extended, by way of pivot about their respective fold lines 54, 62. The second notch 70 is similarly disposed within the locking tab cut line 64, and is located adjacent a post 72 formed in the second panel 32, between the locking tab 52 and support tab 50, and at a location that intersects a line extending from the locking tab fold line 62. The second notch 70 is configured to engage the post 72 via frictional engagement when both the support tab 50 and locking tab 52 have been extended, by way of pivoting about their respective fold lines 54, 62. When the foldable kickstand 24 is deployed, the first and second notches 68, 70 will engage the inner edge 66 of the support tab 50 and post 72 respectively, at substantially 90 degrees from one another. This substantially perpendicular arrangement of the engaged first and second notches 68, 70 stabilizes the foldable kickstand 24 in the deployed orientation.

2. In Use

Having previously described the structure of the playing card holder 20, in accordance with embodiments of the invention, the playing card holder 20 will now be described in use in reference to FIGS. 2-6.

Assembly of the playing card holder 20 includes folding the blank 22 about the first and second fold lines 46, 48, such that the inner surface 36 of the first panel 32 faces the inner surface 38 of the second panel 34 when the blank 22 is folded along the line 30. The first and second panels 32, 34 are then fixed in this folded configuration by applying an adhesive between the panels 32, 34, adjacent the first and second fold lines 46, 48, but ensuring that the adhesive does not inhibit the pivoting movement of the foldable kickstand 24. Alternatively, the panels 32, 34 may be fixed in this folded configuration by use of glue, fasteners, adhesive tape, interlocking folded tabs, or any other suitable fixation mechanism. Similarly, as previously discussed, two independent blanks of first and second panels 32, 34 may be fixed in a substantially folded configuration.

Figure 2:
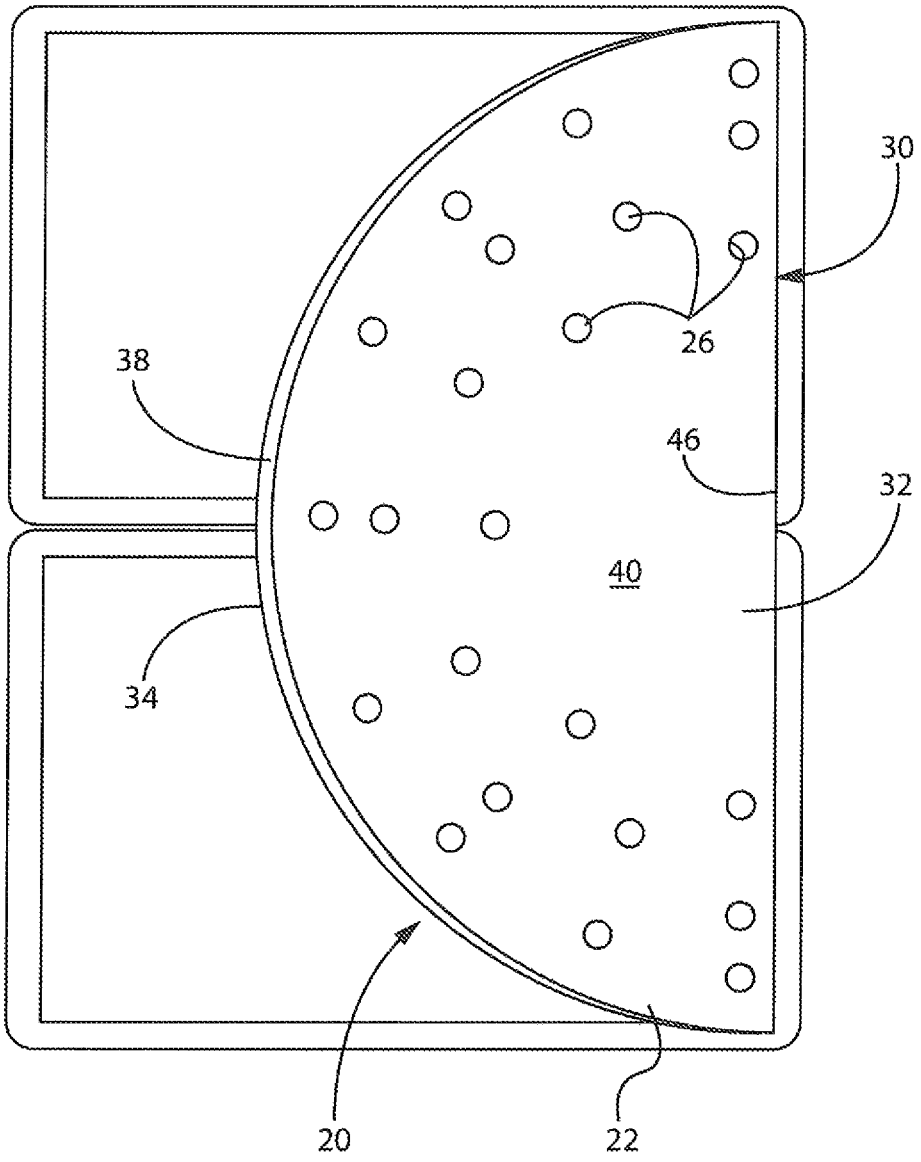
FIG. 2 is a top plan view of the playing card holder of FIG. 1, showing the playing card holder folded and placed on top of a dual deck of playing cards.

Referring now to FIG. 2, the playing; card holder 20 is shown in the folded configuration described above. As seen, the folded playing card holder 20 may have a length and width substantially equal or slightly less than that of a dual deck of standard "poker" playing or other cards of virtually any size. In such an embodiment, the playing card holder 20 may be packaged with or otherwise transported in conjunction with either a single or dual deck of cards without inconveniently adding any substantial bulk.

Figure 3:
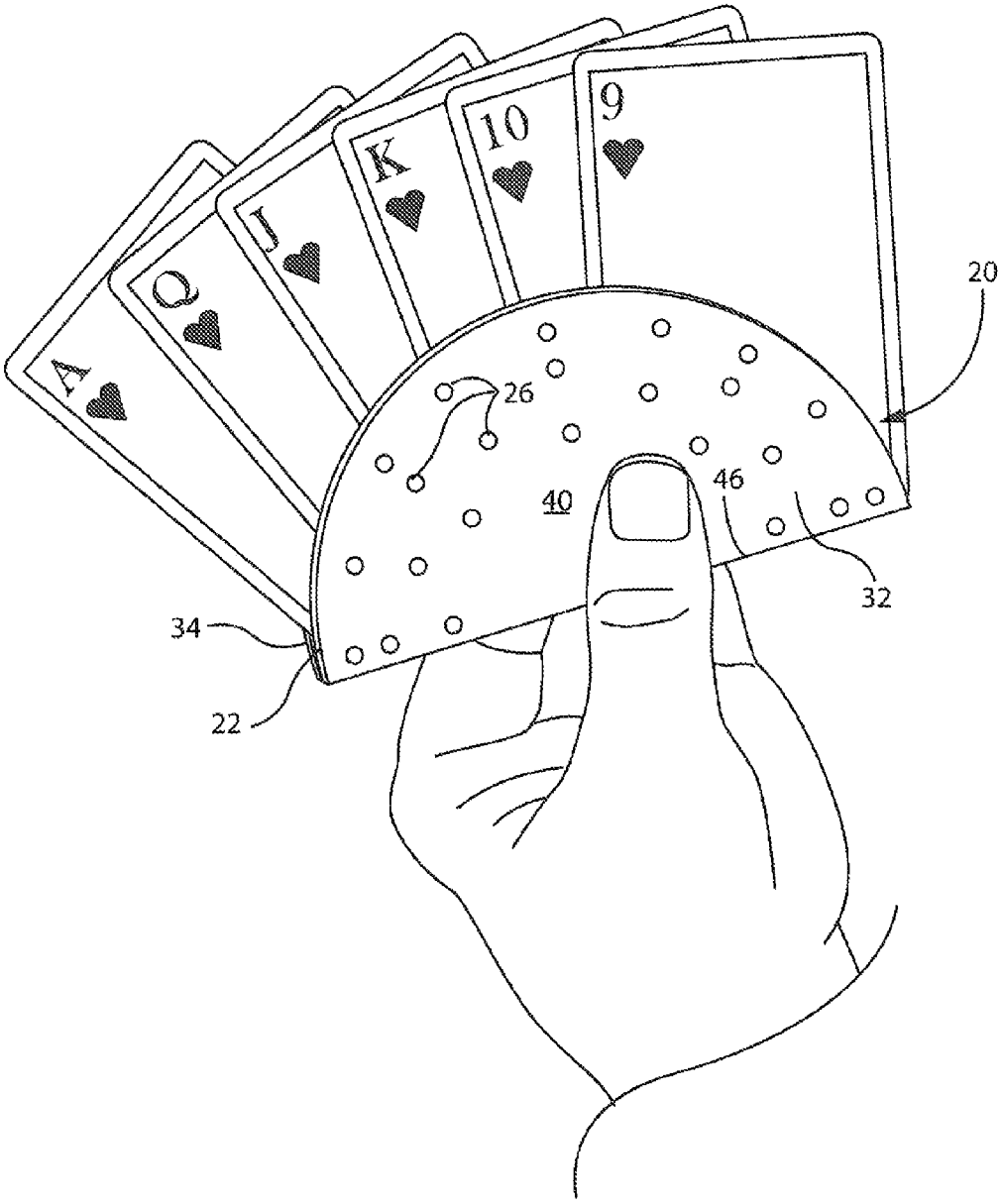
FIG. 3 is a perspective view the playing card holder of FIG. 1, showing the playing card holder held in a player's hand while retaining a plurality of playing cards therein.

Turning now to FIG. 3, the playing card holder 20 is shown in the folded configuration described above with multiple playing cards received within the retaining space 44. As shown in FIG. 3, a player may easily grasp the playing card holder 20 in one hand by pinching the outer surfaces 40, 42 of the first and second panels 32, 34 between two or more fingers. In this hand-held orientation, a player is able to easily hold multiple playing cards within the playing card holder 20, while simultaneously displaying the markings of each card. The multiple playing cards are held securely within the retaining space 44 via frictional engagement with the plurality of protrusions 26 that extend into the retaining space 44. As such, the playing cards can be quickly inserted or removed from the retaining space 44 without dropping a card. In this orientation, the foldable kickstand 24 is collapsed, such that it does not interfere with the player's ability to hold the playing card holder 20.

Alternatively, as seen in FIGS. 4-6, and particularly FIG. 4, the playing card holder 20 may be placed on a table or other flat playing surface by deploying the foldable kickstand 24. In this orientation, the support tab 50 is pivoted outward, about the support tab fold line 54 until it is substantially perpendicular with the plane of the second panel 34, as shown. The locking tab 52 is then pivoted downward, about the locking tab fold line 62 until it is substantially perpendicular to both the plane of the second panel 34 and the plane of the support tab 50. In this orientation, the first notch 68 of the locking tab 52 engages the inner edge 66 of the support tab 50, and the second notch 70 of the locking tab 52 engages the post 72. Resultantly, the foldable kickstand 24 is locked in its deployed position, with the bottom edge 60 of the support tab 50 in a common plane with the first and second fold lines 46, 48, which are used in conjunction to support the playing card holder 20 in slight reclined an upright orientation as shown.

Turning now to FIGS. 5 and 6, the playing card holder 20 is shown having a slight recline when supported by the deployed kickstand 24 in the upright orientation, due to the bottom edge 60 of the support tab 50 being disposed at an angle relative to the first and second fold lines 46, 48, thus tilting the faces of the cards away from the player and allowing easy viewing of the cards by the player. Furthermore, FIGS. 5 and 6 show the interaction of the plurality of protrusions 26 relative to the playing cards. Specifically, as seen in FIG. 5, the protrusions 26 on the first panel 32 are interposed from the protrusions 26 of the second panel 34, such that the protrusions 26 apply opposing force along the length of the playing card within, the retaining space 44. As mentioned above, the second panel 34 of this embodiment has a larger height and/or width than that of the first panel 32, such that the second panel 34 provides additional support for the playing cards when the playing card holder 20 is slightly reclined in the upright orientation. The smaller first panel 32, relative to the second panel 34, further provides ease of access to the playing cards and less visual obstruction to the markings contained thereon.

Many changes and modifications could be made to the invention without departing from the spirit thereof. The scope of these changes and modifications will become apparent from the appended claims.

I claim:

1. A playing card holder, comprising:

a first panel and a second panel, each having a base, an upper edge, an outer surface, and an inner surface;

a retaining space being defined between the inner surfaces of the first and second panels for receiving one or more playing cards;

a playing card retention structure disposed on the inner surface of at least one of the first and second panels; and a foldable kickstand formed on an exterior surface of the playing card holder, wherein the kickstand comprises a first pivotable tab and a second pivotable tab, and wherein the first pivotable tab selectively engages the second pivotable tab when the kickstand is in a deployed orientation thereof.

2. The playing card holder of claim 1, wherein an inner edge of the first pivotable tab selectively engages an outer edge of the second pivotable tab when the kickstand is in a deployed orientation thereof.

3. The playing card holder of claim 1, wherein, when the kickstand is in the deployed orientation thereof, a bottom edge of the first pivotable tab is inclined relative to the bases of each of the first and second panels and the first and second panels extend at an acute angle relative to a vertical plane.

4. The playing card holder of claim 1, wherein the first pivotable tab and the second pivotable tab are generally coplanar with the second panel when the kickstand is in a retracted orientation thereof.

5. The playing card holder of claim 1, wherein the playing card retention structure comprises a high friction material on the inner surface of at least one of the first and second panels configured to engage the one or more playing cards within the retaining space.

6. The playing card holder of claim 1, wherein the playing card retention structure comprises a plurality of protrusions provided on the inner surface of at least one of the first and second panels and extending into the retaining space configured to engage the one or more playing cards within the retaining space.

7. The playing card holder of claim 1, wherein the bases of the first and second panels are linked by a floor forming a bottom of the retaining space, the floor having width of between 0.25 mm and 5 mm.

8. A playing card holder, comprising:

a first panel and a second panel, each having a base, an upper edge, an outer surface, and an inner surface;

a retaining space being defined between the inner surfaces of the first and second panels for receiving one or more playing cards;

a playing card retention structure disposed on the inner surface of at least one of the first and second panels;

a foldable kickstand formed on an exterior surface of the playing card holder, wherein the first panel and second panel are formed from a single blank of material.

9. The playing card holder of claim 8, wherein the single blank of material comprises at least one fold line defining the first and second panels on opposing sides of the at least one fold line.

10. The playing card holder of claim 9, wherein the at least one fold line includes a first fold line, a second fold line, and a space between the first fold line and the second fold line, wherein the space corresponds to a bottom of the playing card holder.

11. A playing card holder, comprising:

a first panel and a second panel, each having a base, an upper edge, an outer surface, and an inner surface, and the bases of the first and second panels being bridged by a floor having a width;

a retaining space being defined between the inner surfaces of the first and second panels for receiving one or more playing cards, a width of a bottom of the retaining space being defined by the width of the floor and being between 0.25 mm and 5 mm;

playing card retention structures disposed on the inner surfaces of the first and second panels; and a foldable kickstand formed within the second panel, the foldable kickstand comprising a first pivotable tab and a second pivotable tab, wherein the first pivotable tab selectively engages the second pivotable tab when the kickstand is in a deployed orientation.

12. The playing card holder of claim 11, wherein, when the kickstand is in the deployed orientation, a bottom edge of the first pivoting first tab is inclined relative to the bases of each of the first and second panels and the first and second panels extend at an acute angle relative to a vertical plane.

13. The playing card holder of claim 11, wherein the first pivotable tab and the second pivotable tab are generally coplanar with the second panel when the kickstand is in a retracted orientation.

14. The playing card holder of claim 11, wherein the playing card retention structure comprises a plurality of protrusions extending into the retaining space configured to engage the one or more playing cards within the retaining space.

15. The playing card holder of claim 11, wherein the first panel and second panel are formed of a single blank of material, and wherein the single blank of material comprises at least one fold line defining the first and second panels on opposing sides of the at least one fold line.

16. The playing card holder of claim 15, wherein the at least one fold line includes a first fold line and a second fold line separated by the first fold line, the space between the first fold line and the second fold, line corresponding to the bottom of the playing card holder.

17. A method of forming a playing card holder, comprising:

forming one or more playing card retention structures onto a surface of a blank;

folding the blank about at least one line to form a first panel and a second panel, each having a base, an upper edge, an outer surface, and an inner surface, a retaining space being defined the inner surfaces of the first and second panels for receiving one or more playing cards; and providing a deployable kickstand on an exterior surface of the playing card holder.

18. The method as recited in claim 17, wherein folding the blank about at least one line comprises the steps of:

folding the blank about a first line, and folding the blank about a second line offset from the first line by a distance, and wherein the first line is parallel to the second line, the distance between the first and second fold lines being equal to a width of a bottom end of the retaining space.

19. The method as recited in claim 17, further comprising deploying the deployable kickstand:

pivoting a first tab of the kickstand about a first pivot line, pivoting a second tab of the kickstand about a second pivot line, and selectively engaging an edge of the first tab with an edge of the second tab as to retain the first and second tabs in a deployed orientation thereof.

* * * * *